US010161128B2

(12) United States Patent
Albartus et al.

(10) Patent No.: US 10,161,128 B2
(45) Date of Patent: Dec. 25, 2018

(54) ANCHOR RAIL AND BUILDING STRUCTURE HAVING AN ANCHOR RAIL

(71) Applicant: HALFEN GMBH, Langenfeld (DE)

(72) Inventors: Dirk Albartus, Bochum (DE); Frank Haeusler, Düsseldorf (DE); Roman Kramer, Erfurt-Salomonsborn (DE); Yapeng Li, Peking (CN)

(73) Assignee: HALFEN GMBH, Langenfeld (DE)

( * ) Notice: Subject to any disclaimer, the term of this patent is extended or adjusted under 35 U.S.C. 154(b) by 0 days.

(21) Appl. No.: 15/620,094

(22) Filed: Jun. 12, 2017

(65) Prior Publication Data

US 2017/0362817 A1 Dec. 21, 2017

(30) Foreign Application Priority Data

Jun. 15, 2016 (CN) ..... 2016 1 0417419

(51) Int. Cl.
*E04B 1/41* (2006.01)
*E21D 11/08* (2006.01)

(52) U.S. Cl.
CPC ..... *E04B 1/41* (2013.01); *E04B 1/4107* (2013.01); *E21D 11/08* (2013.01)

(58) Field of Classification Search
CPC .... E04B 1/4107; E04B 1/4114; E04B 1/4135; E04B 1/41; E21D 11/08; B21D 39/044
See application file for complete search history.

(56) References Cited

U.S. PATENT DOCUMENTS 992,877 A * 5/1911 Kahn ..... E04B 1/4107 52/707
3,535,846 A * 10/1970 Storch ..... E04L 32/58 52/489.1

(Continued)

FOREIGN PATENT DOCUMENTS

CA 2380548 A1 * 10/2003 ..... E04B 1/41
CA 2786640 C * 5/2017 ..... E21B 11/08

(Continued)

OTHER PUBLICATIONS

Machine-Translate_FR2330816A1.pdf , retrieved from EPO website (Year: 1977).*

*Primary Examiner* — Babajide A Demuren
(74) *Attorney, Agent, or Firm* — Lucas & Mercanti, LLP; Klaus P. Stoffel

(57) ABSTRACT

An anchor rail has a base body having a longitudinal groove that extends along a longitudinal center line of the anchor rail, and a rail back, fixed with an anchor, on the side opposite the longitudinal groove. The base body has a one front side perpendicular to the longitudinal center line and fixed with an end plate that protrudes beyond the rail back to the side of the base body facing away from the longitudinal groove and supports an anchoring element, which extends from the side of the end plate on which the base body is arranged. The end plate is flush to the front side and does not protrude into the base body. For a building structure with a concrete member, into which an anchor rail is cast, the longitudinal groove is on a first router side of the concrete member. The end plate runs along a second side of the concrete member and the anchoring element protrudes into the concrete member.

16 Claims, 3 Drawing Sheets

(56) References Cited

U.S. PATENT DOCUMENTS

| | | | | | |
|---|---|---|---|---|---|
| 4,948,313 | A * | 8/1990 | Zankovich | E04B 1/4107 | 411/103 |
| 5,729,951 | A * | 3/1998 | Frohlich | B21K 25/00 | 52/698 |
| 8,234,832 | B2 * | 8/2012 | Birnbaum | E04B 1/4107 | 411/111 |
| 2006/0123726 | A1 * | 6/2006 | Azarin | E04B 1/4107 | 52/334 |
| 2008/0072530 | A1 * | 3/2008 | Sum | E04B 1/4107 | 52/846 |
| 2009/0064626 | A1 * | 3/2009 | Sen | E04B 1/4107 | 52/699 |
| 2010/0170185 | A1 * | 7/2010 | Birnbaum | E04B 1/4107 | 52/699 |
| 2013/0248671 | A1 * | 9/2013 | Schleiermacher | E04B 1/41 | 248/309.1 |
| 2014/0318074 | A1 * | 10/2014 | Heudorfer | E04B 1/4107 | 52/710 |

FOREIGN PATENT DOCUMENTS

| | | | | | |
|---|---|---|---|---|---|
| DE | 19903258 | C2 | | 8/2000 | |
| DE | 20302492 | U1 | | 4/2003 | |
| DE | 102007040279 | A1 | * | 2/2009 | B28B 23/005 |
| DE | 202014006758 | U1 | * | 9/2014 | E04B 1/4107 |
| EP | 2907932 | A1 | * | 8/2015 | E04B 1/4107 |
| EP | 2907932 | A1 | | 8/2015 | |
| EP | 2937492 | B1 | * | 11/2017 | E04F 13/0841 |
| FR | 2330816 | A1 | * | 6/1977 | E02D 5/808 |
| GB | 687272 | A | | 2/1953 | |
| WO | WO-2017075332 | A1 | * | 5/2017 | E04B 1/4107 |

* cited by examiner

ANCHOR RAIL AND BUILDING STRUCTURE HAVING AN ANCHOR RAIL

CROSS-REFERENCE TO RELATED APPLICATIONS

The present application claims priority of CN 2016 10 417 419.6, filed Jun. 15, 2016, the priority of this application is hereby claimed and this application is incorporated herein by reference.

BACKGROUND OF THE INVENTION

The invention relates to an anchor rail having a base body, wherein the base body has a longitudinal groove, which extends in the direction of a longitudinal center line of the anchor rail. On the side located opposite the longitudinal groove, the base body has a rail back, to which at least one anchor is fixed, and wherein the base body has at least one front side, which runs at right angles to the longitudinal center line and to which an end plate is fixed. The end plate protrudes beyond the rail back to the side of the base body facing away from the longitudinal groove and supports an anchoring element, which extends from the end plate to the side of the end plate, on which the base body is arranged. The invention further relates to a building structure comprising at least one concrete member, into which an anchor rail is cast.

An anchor rail comprising anchors, in the end section of which an end anchor is inserted, is known from DE 199 03 258 C2. The end anchor has an insert element, which protrudes into the anchor rail. A mounting plate, on which an anchor element is arranged, is arranged on the insert element.

SUMMARY OF THE INVENTION

The invention is based on the object of creating an anchor rail, which can be used in a variety of ways. It is a further object of the invention to specify a building structure having an anchor rail.

This object is solved by an anchor rail, in the case of which the end plate is fixed to the front side in a flush manner and does not protrude into the base body. In the case of a building structure, the object is solved by a concrete member, into which an anchor rail is cast, wherein the longitudinal groove is arranged on a first side of the concrete member, and the first side is an outer side of the concrete member, wherein the end plate runs along a second side of the concrete member and wherein the anchoring element protrudes into the concrete member.

It is provided that the end plate is fixed to the front side of the base body in a flush manner and does not protrude into the base body. The entire length of the base body can thus be used to arrange fastening elements in the rail. The end plate is thereby directly fixed to the base body of the anchor rail, and not via further fastening elements or the like. Further fastening elements, such as insert elements or the like, can thus be omitted. A sufficient anchoring of the anchor rail on its end is attained by means of the anchoring element. The anchor rail can thus be directly installed on the edge of a concrete member, without reducing the load carrying capacity, in particular tension and transversal tension in the longitudinal rail direction.

A good fixation of the anchor rail in the area of the end plate is attained, when the anchoring element has a length, which is measured in the direction of the longitudinal center line of the anchor rail to the end plate and which corresponds to at least 0.5 times the height of the base body. Advantageously, the length of the anchoring element corresponds at least to the height of the base body. Particularly advantageously, the length of the anchoring element is between 1.5 times and 4 times the height of the base body.

To attain a good fixation of the anchoring element, provision is advantageously made for the anchoring element to have an anchoring section, which forms an undercut in the direction of the end plate. In a viewing direction in the longitudinal direction of the anchoring element, the anchoring section accordingly protrudes beyond the area of the anchoring element located between the anchoring section and the end plate in at least one direction. The anchoring element is in particular a cross anchor, the anchor head of which forms the anchoring section. Other designs of the anchoring element, however, can be advantageous as well. The anchoring element can in particular be embodied in a rod-shaped manner, preferably of concrete steel. The anchoring element, however, can also be flat steel, a steel profile, a screw or a head bolt. Other designs of the anchoring element can be advantageous as well.

Advantageously, the diameter of the cross anchor corresponds at least to the diameter of an anchor of the anchor rail. The diameter of the cross anchor is thereby not measured in the anchoring section, but in the area located between anchoring section and end plate. The diameter of the anchor is likewise not measured on an anchor head of the anchor, but in the area located between anchor head and rail. The nominal diameter is identified as diameter of an anchor.

Advantageously, the distance of the anchoring element to the rail back of the anchor rail is comparatively large. By arranging the anchoring element at a comparatively large distance to the rail back, more concrete volume can be activated, which leads to an improved anchoring and thus does not lead to a reduction of the bearing load in the areas of the concrete member close to the edge. The distance of the anchoring element to the rail back is preferably larger than the length of at least one anchor of the anchor rail. In the installed state, the anchoring element is thus located below, thus on the side of the at least one anchor facing away from the base body. The anchoring element has a longitudinal center line, which advantageously draws an angle of less than 30° with a longitudinal center line of the anchor rail. The anchoring element thus extends approximately in the longitudinal rail direction. Particularly preferably, the longitudinal center line of the anchoring element runs parallel to the longitudinal center line of the anchor rail. Advantageously, the longitudinal center line of the anchoring element has a distance to the rail back of at least 110% of the length of the at least one anchor. If the longitudinal center line of the anchoring element does not run parallel to the longitudinal center line of the anchor rail, the distance between the longitudinal center line of the anchoring element and the rail back is measured on the free end of the anchoring element.

Advantageously, the end plate completely covers the longitudinal groove on the front side of the base body. The end plate thereby preferably terminates flush with an outer side of the base body of the anchor rail. The base body has a width, which is measured vertically to the longitudinal center line of the anchor rail and vertically to the height. Advantageously, the width of the base body is smaller than the width of the end plate measured in the same direction. The end plate thus protrudes laterally beyond the base body of the anchor rail. A simple fixation of the end plate to the base body is thus possible, in particular by means of welding.

Advantageously, the thickness of the end plate measured parallel to the longitudinal center line of the anchor rail is less than 0.5 times the height of the base body of the anchor rail. The thickness of the end plate is preferably less than one-fourth of the height of the base body of the anchor rail. In the case of a flush installation of the end plate in a concrete member, the thickness of the end plate determines the minimum distance of a fastening element to the outer side of the concrete member. Due to a comparatively thin design of the end plate, this distance can be very small, so that fastening elements can be mounted very close to an outer side of the concrete member.

Advantageously, the end plate is non-detachably connected to the base body. A particularly advantageous design is attained, when the end plate is frontally welded to the base body. Advantageously, the anchoring element is non-detachably connected to the end plate. The anchoring element can also be connected to the end plate by means of welding. However, a different fastening technology can be advantageous as well.

For a building structure having at least one concrete member, into which an anchor rail is cast, it is provided that the longitudinal groove of the anchor rail is arranged on a first side of the concrete member, wherein the first side is an outer side of the concrete member. On the outer side of the concrete member, fastening elements can thus be fixed to the anchor rail. Advantageously, the end plate runs along a second side of the concrete member, and the anchoring element protrudes into the concrete member. The outer side of the end plate facing away from the base body advantageously runs flush with the second side of the concrete member, and the anchoring element is preferably arranged completely inside the concrete member. Particularly preferably, the concrete member is a segment of a tunnel or a ceiling panel of a building. When using the anchor rail according to the invention in segments of a tunnel, a largely circumferential fastening possibility can be attained in the tunnel. The areas, in which fastening elements cannot be arranged in the rail, are formed by the two very narrow end plates of the segments located next to one another in the circumferential direction.

In the case of ceiling panels of buildings, a fastening possibility close to the edge is desired as well. This is advantageous in particular when curtain wall elements are to be arranged on the ceiling panel. If the anchor rail is used in a ceiling panel of a building to fasten glass fronts, material can be saved due to the installation of the fastening elements close to the edge, because the fastening elements for fixing the facade elements can be designed to be smaller.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
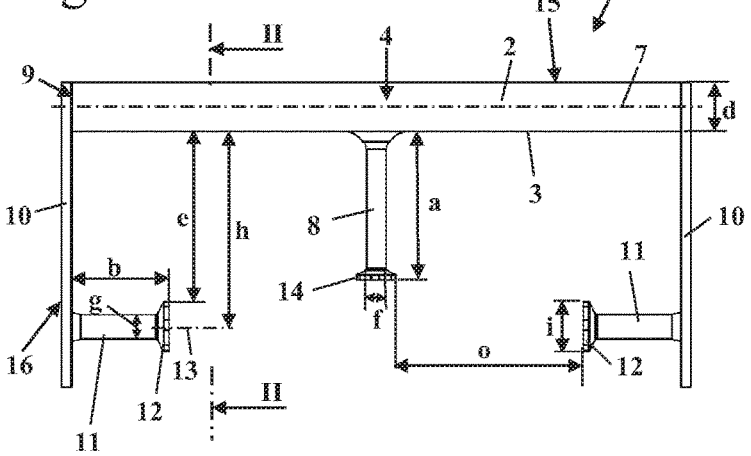
FIG. 1 shows a side view of an anchor rail.

FIG. 1 shows an exemplary embodiment of an anchor rail 1. The anchor rail 1 has a base body 2. In the illustration in FIG. 1, the length of the base body 2 is relatively small. The length of the base body 2 can be adapted to the respective intended purpose, as needed. The base body 2 has an outer side 15, which is provided for the flush installation on an outer side of a building structure made of concrete. On the side facing away from the outer side 15, the base body 2 has a rail back 3, which, in the installed state, is embedded in the concrete. The base body 2 has a height d, which is measured vertically to the rail back. Anchors 8 are fixed to the rail back 3. Only one anchor 8 is shown in the illustration in FIG. 1. However, a different number of anchors 8 can be advantageous as well. Advantageously, the number of the anchors 8 is adapted to the length of the rail and to the intended load in the usual manner. Advantageously, the anchors 8 are arranged at regular intervals on the rail back 3.

The anchor 8 has a length a measured vertically to the rail back 3, which is significantly larger than the height d of the base body 3 measured in the same direction. The length a and the height d are measured vertically to the surface of a concrete member and vertically to the outer side 15. Advantageously, the length a is at least twice, preferably more than 2.5 times the height d. The anchor 8 has a diameter f The diameter f is the nominal diameter of the anchor 8 and is measured in a rod-shaped, advantageously cylindrical middle section of the anchor 8. On the side facing away from the rail back 3, the anchor 8 supports an anchor head 14. The anchor 8 is widened on the anchor head 14 and has an enlarged diameter. The anchor head 14 can be produced for example by compressing the free end of the anchor 8.

On its ends, the base body 2 of the anchor rail 1 has front sides 9. An end plate 10 is fixed to every front side 9. The end plate 10 abuts on the front side 9 in a flush manner and is fixed directly and without further fastening elements to the front side 9, in particular by means of welding. The end plate 10 is formed as flat plate. The end plate 10 supports an anchoring element, which is formed as cross anchor 11 in the exemplary embodiment. The cross anchor 11 protrudes from the end plate 10 to the side of the end plate 10, on which the base body 2 is arranged as well. The cross anchor 11 has a longitudinal center line 13, which, in the exemplary embodiment, runs parallel to a longitudinal center line 7 of the base body 2. However, it can also be provided that the longitudinal center line 13 of the cross anchor 10 runs at an incline to the longitudinal center line 7 of the base body 2. This is provided in particular in the case of a curved course of the base body 2. Advantageously, the angle, which the longitudinal center line 7 draws with the longitudinal center line 13 of the cross anchor 11, is smaller than 30°. The cross anchor 11 thus extends at least approximately in the direction of the longitudinal center line 7.

The cross anchor 11 has a length b, which advantageously corresponds to at least 0.5 times the height d of the base body 2. The length d preferably corresponds at least to the height d of the base body. A very good anchoring and a high bearing load is attained in the end areas of the base body 2, when the length b is at least 1.5 times, preferably at least 2 times the height d. The cross anchor 11 has a diameter g, which is the nominal diameter of the cross anchor 11 and which, in the exemplary embodiment, is larger than the diameter f of the anchor 8 fixed to the base body 30. On its side facing away from the end plate 10, the cross anchor 11 also has an anchor head 12. At the anchor head 12, the cross anchor 11 has an enlarged outer diameter. The anchor head 12 thus forms an undercut in the direction of the end plate 10. At the anchor head 12, the cross anchor 11 has a diameter i, which advantageously corresponds to at least 1.2 times, in particular to at least 1.5 times the diameter g of the cross anchor 11 in the area located between anchor head 12 and end plate 10. The diameter g is thereby the smallest diameter of the cross anchor 11. In the exemplary embodiment, the diameter i is approximately twice the diameter g.

In the exemplary embodiment, the cross anchor 11 runs completely below the at least one anchor 8. The cross anchor 11 has a smallest distance e to the rail back 3, which is larger than the length a of the anchor 8. The distance e is thereby only slightly larger than the distance a. The distance e can for example be approximately between 1.1 times and 1.5 times the length a. The longitudinal center line 13 of the cross anchor 11 has a distance h, which is advantageously at least 110% of the length a of the anchor 8, to the rail back 3. Advantageously, the distance h is at least 120% of the length a. The distance h is in particular between 120% and 180% of the length b. The cross anchor 11 has a distance o to the anchor 8, which is measured parallel to the longitudinal center line 7 and which advantageously corresponds at least to the length b of the cross anchor 11. Advantageously, the distance o is between 1 times and 3 times the length b. A good activation of the concrete is thus attained. The distance o is thereby measured between the anchor heads 12 and 14 and parallel to the longitudinal center line 7 on the anchor 8.

Figure 2:
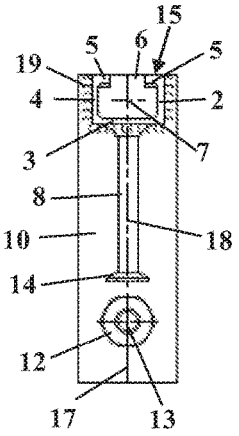
FIG. 2 shows a schematic sectional illustration of the anchor rail along the line II-II in FIG. 1.

FIG. 2 shows the design of the base body 2 in detail. The cross section of the base body 2 is formed approximately U-shaped. Side walls 4, which run in the longitudinal direction of the rail back 3, are arranged on the rail back 3. In the exemplary embodiment, the side walls 4 run vertically to the rail back 3. Angled sections 5, which protrude towards one another, are arranged on the side of the side walls 4 facing away from the rail back 3. A longitudinal groove 6, to which fastening elements can be fixed, is formed between the angled sections 5. The angled sections 5 and the longitudinal groove 6 thereby extend along the outer side 15 of the anchor rail 1. In the exemplary embodiment, the angled sections 5 are oriented parallel to the rail back 3.

The anchor 8 has a longitudinal center line 18. The longitudinal center line 18 is located in a longitudinal center plane 17 of the anchor rail 1, in which the longitudinal center line 13 of the cross anchor 11 as well as the longitudinal center line 7 run as well. The anchor rail 1 is formed mirror-symmetrically to its longitudinal center plane 17. As FIG. 2 also shows schematically, the base body 2 is fixed to the end plate 10 via a weld seam 19, which runs along the side walls 4 and the rail back 3.

Figure 3:
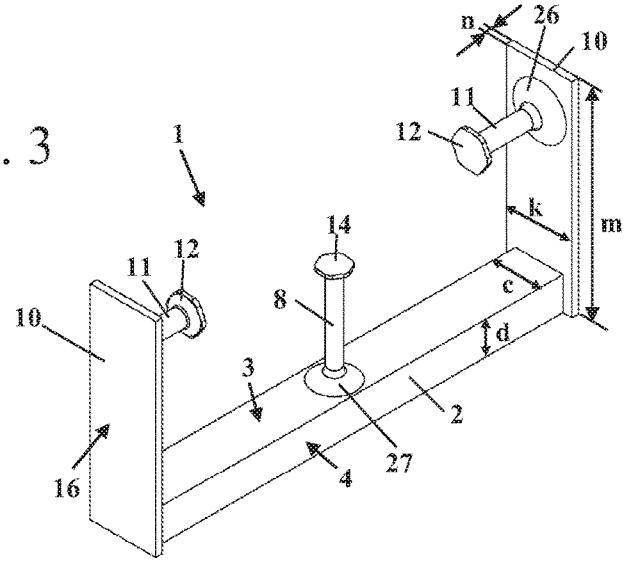
FIG. 3 shows a perspective illustration of the anchor rail from FIG. 1.

To make sufficient space for the weld seam 19, the end plate 10 laterally protrudes beyond the base body 2. This is illustrated in FIG. 3. The base body 2 has a width c, which is measured vertically to the height d and vertically to the longitudinal center line 7 (FIG. 1). The end plate 10 has a width k, which is measured in the same direction and which is larger than the width c of the base body 2. Advantageously, the width k is larger than the width c by at least twice the width of the weld seam 19. The end plate 10 has a height m, which is measured parallel to the height d of the base body 2. The height m is significantly larger than the width k of the end plate 10. The height m is more than twice, advantageously approximately 3 times the width k. The end plate 10 has a thickness n, which is measured parallel to the longitudinal center line 7 of the base body 2. Advantageously, the thickness n is chosen to be comparatively small. Advantageously, the thickness n is less than 0.5 times the height d, in particular less than one-fourth of the height d of the base body 2. Advantageously, the thickness n is less than 10 mm. The longitudinal groove 6 thus protrudes close to a front side of a concrete member, into which the anchor rail 1 is cast.

As shown in FIGS. 1 and 3, the base body 2 and the cross anchor 11 in each case protrude to the same side of an end plate 10. Advantageously, the cross anchors 11 are also fixed to the end plate 10 by means of welding. In the exemplary embodiment, a weld seam 26 is provided for this purpose. In the exemplary embodiment, the anchor 8 is fixed to the rail back 3 via a weld seam 27. The end plates 10 in each case have an outer side 16, which faces away from the cross anchor 11 and the base body 2 of the anchor rail 1 and which is provided for the flush installation on a front side of a concrete member.

Figure 4:
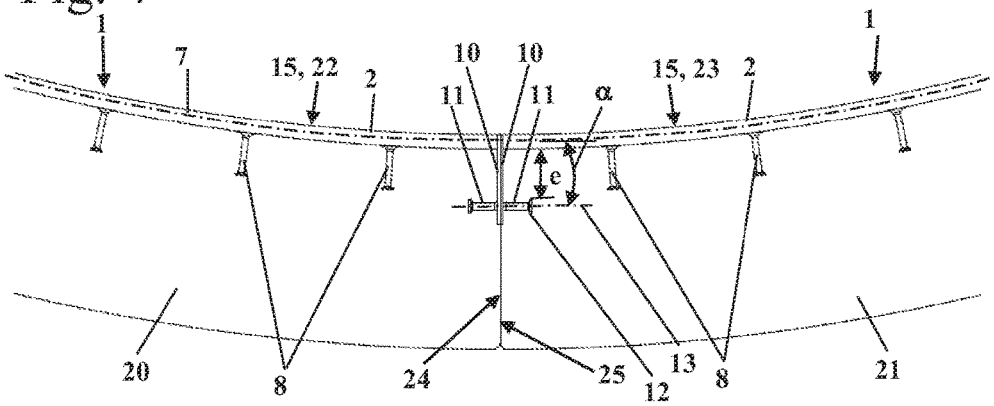
FIG. 4 shows a schematic side view of an exemplary embodiment for anchor rails in adjoining segments of a tunnel.

FIG. 4 shows two anchor rails 1, which are cast into two segments 20 and 21. The segments 20 and 21 are arranged adjacent to one another in the circumferential direction of a tunnel tube. The anchor rails 1 are in each case arranged such that the outer side 15 in the anchor rail 1 terminates flush with a first side 22 of the segment 20 or with a first side 23 of the segment 21, respectively. The first sides 22 and 23 are the outer sides of the segments 20 and 21, which protrude radially inwards in the installed state and which delimit the tunnel tube. The opposite outer side of the segments 20, 21 faces the ground.

The segment 20 has a second side 24, which forms a front side of the segment 20. The segment 21 has a corresponding second side 25. The second sides 24 and 25 of the two segments 20 and 21 are located adjacent to one another in the circumferential direction of the tunnel tube. The end plate 10 of the anchor rail 1 in the segment 20 is cast into the segment 20 so as to be flush with the second side 24. The end plate 10 of the anchor rail 1 is accordingly arranged in the segment 21 so as to be flush with the second side 25. The cross anchors 11 in each case protrude into the segments 20, 21. The outer sides 15 of the anchor rails 1 run flush with the outer sides 22 and 23 along the tunnel wall. The longitudinal center lines 7 of the anchor rails 1 run in a curved manner, following the tunnel wall. The longitudinal center lines 13 of the cross anchors 11 thus run parallel to the longitudinal center line 7 only along the front sides 24 and 25, which adjoin one another. On the anchor head 12 of the cross anchors 11, the longitudinal center line 13 draws an angle α, which can be between 0° and 30°, with the longitudinal center line 7 at this location. In the exemplary embodiment, the angle α is significantly smaller than 30° and is advantageously between 1° and 10°.

Figure 5:
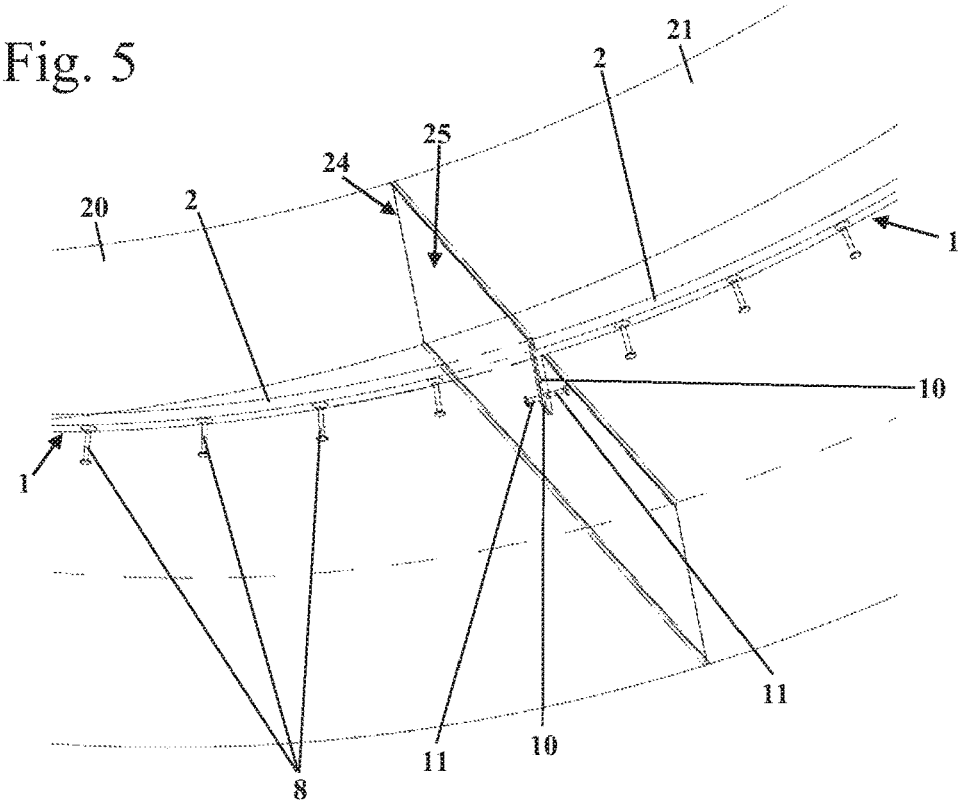
FIG. 5 shows a schematic perspective illustration of the arrangement from FIG. 4.

FIG. 5 shows the arrangement from FIG. 4 in perspective illustration. For the sake of clarity, the edge of the segments 20 and 21 located in the back as well as the section of the anchor rail 1 covered by the sides 24 and 25 are thereby drawn by means of dashed lines. The further edges are illustrated schematically and not by means of dashed lines. As is shown by the illustration in FIG. 5, the end plates 10 of the two anchor rails 1 are directly adjacent to one another. The cross anchors 11 protrude away from the end plates 10 into the segments 20 and 21.

Figure 6:
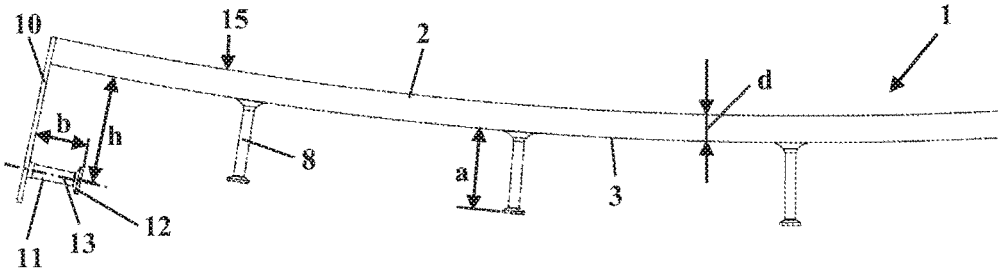
FIG. 6 shows a side view of a section of an anchor rail for a segment.

FIG. 6 shows the anchor rail 1 arranged in the segment 21 in side view. On the anchor head 12, the longitudinal center line 13 of the cross anchor 11 has a distance h to the rail back 3, which is larger than the length a of the anchors 8. The distance h is thereby measured at the intersection of the longitudinal center line 13 with the end of the cross anchor 11 facing away from the end plate 10. The free end of the cross anchor 11 has the distance b, which is at least half as large as the height d of the base body 2, to the end plate 10.

Figure 7:
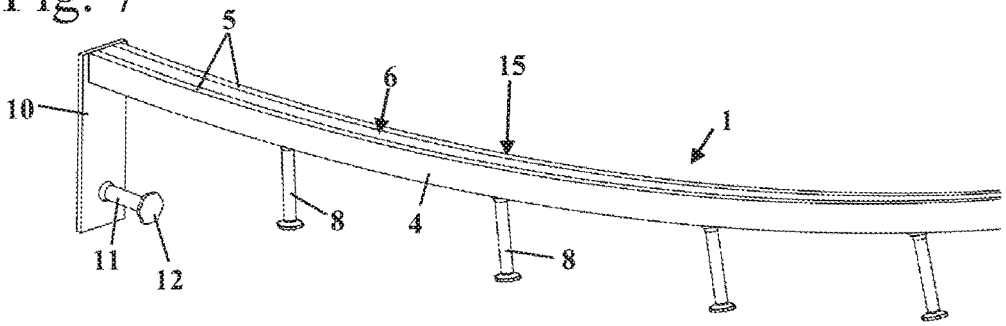
FIG. 7 shows the anchor rail from FIG. 6 in perspective illustration.

As shown by the perspective illustration in FIG. 7, the longitudinal groove 6 extends along the outer side 15 of the anchor rail 1 up to the end plate 10. The longitudinal groove 6 is closed by the end plate 10. Up to the end plate 10, the longitudinal groove 6 and the interior of the base body 2 are completely available for fastening means, such as anchor head screws, for example. Advantageously, the end plate 10 extends vertically to the longitudinal center line 7 of the anchor rail 1 (FIG. 1).

Figure 8:
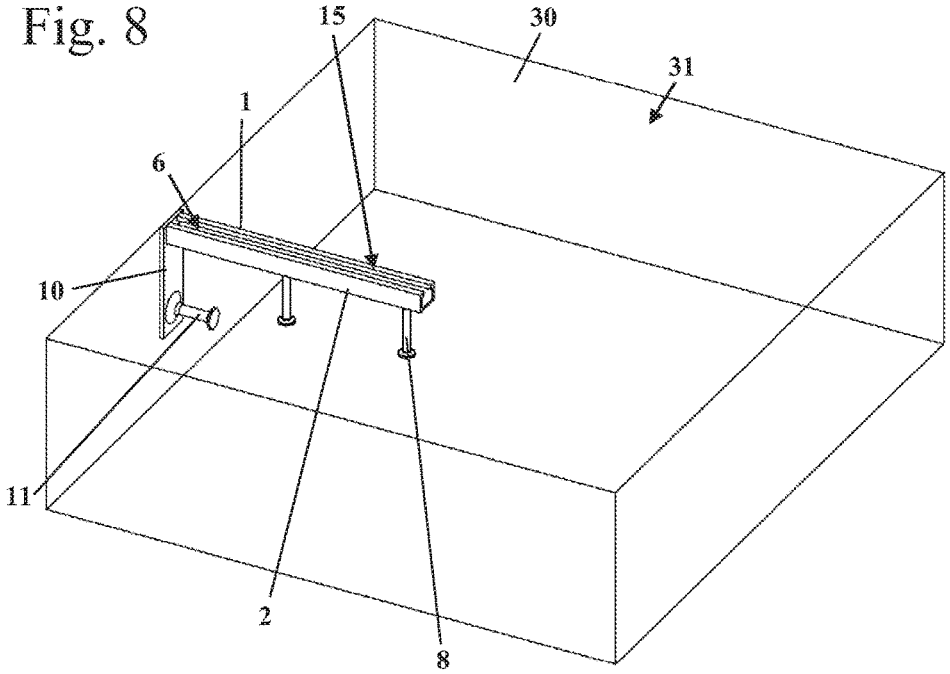
FIG. 8 shows a perspective illustration of an anchor rail in a ceiling panel of a building, wherein the ceiling panel is illustrated so as to be transparent.
Figure 9:
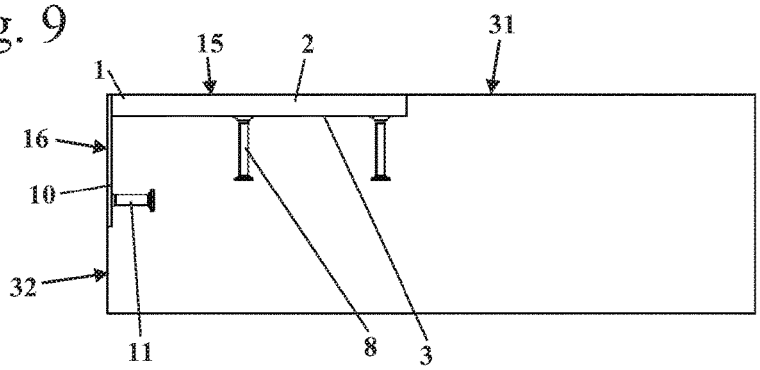
FIG. 9 shows a schematic side view of the arrangement from FIG. 8.

FIG. 8 shows the arrangement of an anchor rail 1 in a ceiling panel 30 of a building structure, in particular of a building. The ceiling panel 30 has a first side 31, which is an outer side of the ceiling panel 30. The side 31 can in particular run along an outer wall of a building, to which curtain wall elements are to be mounted. The outer side 15 of the anchor rail 1 runs flush along the first side 31. The end plate 10 extends along a second side 32, which is shown in FIG. 9. The second side 32 is a front side of the ceiling panel 30. A further ceiling panel can follow on from the second side 32. The outer side 16 of the end plate 10 is arranged so as to be flush with the second side 32 of the ceiling panel 30. The anchors 8 and the cross anchor 11 protrude into the ceiling panel 30. The longitudinal groove 6 extends close to the second side 32 and has a distance, which corresponds to the thickness of the end plate 10, to the second side 32. Facade elements can thus be fixed to the anchor rail 1 close to the second side. The protruding length of the fastening elements can thus be kept small, resulting in smaller loads on the fastening elements and thus in lower demands on the stability of the fastening elements.

Figure 10:
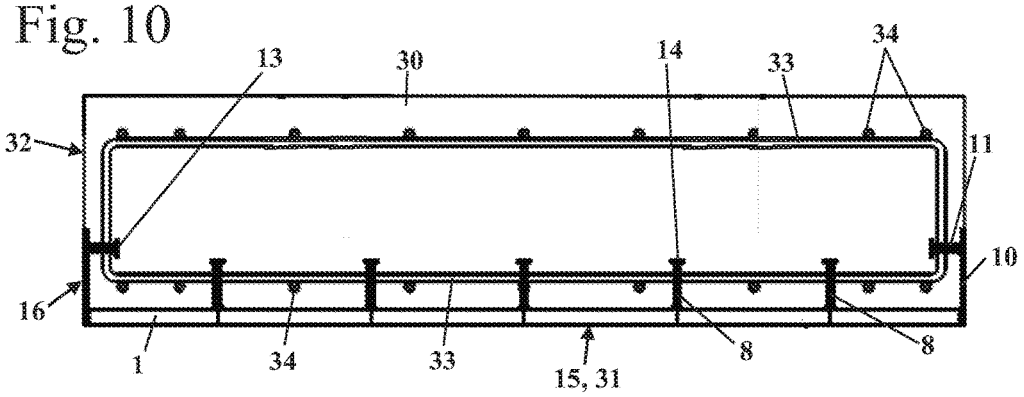
FIG. 10 shows a sectional illustration of an exemplary embodiment of the arrangement of an anchor rail in a ceiling panel of a building.

FIG. 10 shows the arrangement of an anchor rail 1 in a ceiling panel 30, which has a steel reinforcement. The ceiling panel 30 has longitudinal reinforcements 33 embodied as circumferential ring in the exemplary embodiment. The anchors 8 and the cross anchors 11 protrude through the longitudinal reinforcement 33. The anchor heads 14 of the anchors 8 are located on the side of the longitudinal reinforcement 33, which faces away from the first side 31 and the outer side 15. The cross anchors 11 also protrude past the longitudinal reinforcements 33 into the interior of the ceiling panel 30. The anchor heads 13 of the cross anchors 11 are located on the side of the longitudinal reinforcement 33, which faces away from the second side 32 of the ceiling panel 30. The reinforcement of the ceiling panel 30 furthermore comprises cross reinforcements 34, which, in the exemplary embodiment, run between the longitudinal reinforcement 33 and the respective side 31, 32 of the ceiling panel 30. Due to the fact that the anchors 8 and 11 protrude beyond the reinforcements 33, 34 into the interior of the ceiling panel 30, an improved anchoring of the anchor rail 1 is attained.

While specific embodiments of the invention have been shown and described in detail to illustrate the inventive principles, it will be understood that the invention may be embodied otherwise without departing from such principles.

We claim:

1. An anchor rail comprising a base body, wherein the base body has a longitudinal groove that extends in a direction of a longitudinal center line of the anchor rail, wherein, on a side located opposite the longitudinal groove, the base body has a rail back; at least one anchor fixed to the rail back, and wherein the base body has a one front side that runs transverse to the longitudinal center line; an end plate fixed to the front side, wherein the end plate protrudes beyond the rail back to the side of the base body located opposite the longitudinal groove; and an anchoring element mounted on the end plate so as to extend from the end plate to a side of the end plate on which the base body is fixed, wherein the end plate is fixed to the front side so as to be flush and not protrude into the base body.

2. The anchor rail according to claim 1, wherein the anchoring element has a length in a direction parallel to the longitudinal center line of the anchor rail and up to the end plate that corresponds to at least 0.5 times a height of the base body.

3. An anchor rail comprising base body, wherein the base body has a longitudinal groove that extends in a direction of a longitudinal center line the anchor rail, wherein, on a side located opposite the longitudinal groove, the base body has a rail back; at least one anchor fixed to the rail back, and wherein the base body has a one front side that runs transverse to the longitudinal center line; an end plate fixed to the front side, wherein the end plate protrudes beyond the rail back to the side of the base body located opposite the longitudinal groove; and an anchoring element mounted on the end plate so as to extend from the end plate to a side of the end plate on which the base body is fixed, wherein the end plate is fixed to the front side so as to be flush and not protrude into the base body, wherein the anchoring element has an anchoring section that forms an undercut in a direction of the end plate.

4. The anchor rail according to claim 3, wherein the anchoring element is a cross anchor that has an anchor head that forms the anchoring section.

5. The anchor rail according to claim 4, wherein the cross anchor has a diameter that corresponds at least to the diameter of the anchor.

6. The anchor rail according to claim 1, wherein a distance of the anchoring element to the rail back is larger than. a length of the at least one anchor.

7. The anchor rail according to claim 1, wherein a longitudinal center line of the anchoring element forms an angle of less than 30 ° with the longitudinal center line of the anchor rail.

8. The anchor rail according to claim 7, wherein the longitudinal center line of the anchoring element is at a distance to the rail back that is at least 110 % of a length of the at least one anchor.

9. An anchor rail comprising a base body, wherein the base body has a longitudinal groove that extends in a direction of a longitudinal center line of the anchor rail, wherein, on a side located opposite the longitudinal groove, the base body has a rail back; at least one anchor fixed to the rail, back and wherein the base body has a one front side that runs transverse to the longitudinal center line; an end plate fixed to the front side, wherein the end plate protrudes beyond the rail back to the side of the base body located opposite the longitudinal groove; and an anchoring element mounted on the end plate so as to extend from the end plate to a side of the end plate on which the base body is fixed, wherein the end plate is fixed to the front side so as to be flush and not protrude into the base body, wherein the end plate completely covers the longitudinal groove on the front side of the base body.

10. The anchor rail according to claim 1, wherein the base body has a width perpendicular to the longitudinal center line of the anchor rail and perpendicular to a height of the base body, the width being smaller than width of the end plate measured in the same direction.

11. The anchor rail according to claim 1, wherein the end plate has a thickness measured parallel to the longitudinal center line of the anchor rail that is less than 0.5 times a height of the base body.

12. The anchor rail according to claim 1, wherein the end plate is non-detachably connected to the base body and the anchoring element is non-detachably connected to the end plate.

13. A building structure, comprising: at least one concrete member; and an anchor rail according to claim 1 cast into the concrete member, wherein the longitudinal groove is arranged on a first side of the concrete member, wherein the first side is an outer side of the concrete member, wherein the end plate runs along a second side of the concrete member and wherein the anchoring element protrudes into the concrete member.

14. The building structure according to claim 13, wherein an outer side of the end plate facing away from the base body runs flush with the second side, and the anchoring element is arranged completely inside the concrete member.

15. The building structure according to claim 13, wherein the concrete member is a segment of a tunnel or a ceiling panel of a building structure.

16. An anchor rail comprising a base body, wherein the base body has an interior and a longitudinal groove that extends in a direction of a longitudinal center line of the anchor rail, wherein, on a side located opposite the longitudinal groove, the base body has a rail back; at least one anchor fixed to the rail back, and wherein the base body has a one front side that runs transverse to the longitudinal center line; an end plate fixed to the front side, wherein the end plate protrudes beyond the rail back to the side of the base body located opposite the longitudinal groove; and an anchoring element mounted on the end plate so as to extend from the end plate to a side of the end plate on which the base body is fixed, wherein the end plate is fixed to the front side so as to be flush and not protrude into the base body, and wherein the end plate abuts the front side, so that the interior of the base body is available for fasteners up to the front side of the base body.

* * * * *